US007066340B2

(12) United States Patent
Robertson

(10) Patent No.: US 7,066,340 B2
(45) Date of Patent: Jun. 27, 2006

(54) NECK-HANGING COOLER DOOR SHELF DEVICE

(75) Inventor: James David Robertson, Atlanta, GA (US)

(73) Assignee: Display Industries, LLC., Norcross, GA (US)

( * ) Notice: Subject to any disclaimer, the term of this patent is extended or adjusted under 35 U.S.C. 154(b) by 29 days.

(21) Appl. No.: 10/947,467

(22) Filed: Sep. 22, 2004

(65) Prior Publication Data

US 2006/0060548 A1 Mar. 23, 2006

(51) Int. Cl.
*A47B 73/00* (2006.01)

(52) U.S. Cl. ..... 211/74; 211/59.2; 211/75; 248/312

(58) Field of Classification Search ..... 211/74, 211/59.2, 162, 71.01, 75, 164; 248/312, 248/312.1; 312/72, 36, 73; 206/139; 40/446; D6/574

See application file for complete search history.

(56) References Cited

U.S. PATENT DOCUMENTS 1,243,059 A * 10/1917 Friesleben ..... 211/90.01
1,933,374 A * 10/1933 Haggard ..... 248/206.1
2,327,379 A * 8/1943 Thomas ..... 211/74
4,367,818 A * 1/1983 Suttles ..... 211/59.2
4,401,221 A * 8/1983 Suttles ..... 211/59.2
4,984,693 A * 1/1991 Belokin et al. ..... 211/88.01
5,096,272 A * 3/1992 Belokin et al. ..... 312/129
D327,197 S * 6/1992 Belokin et al. ..... D6/567
5,351,841 A * 10/1994 Belokin et al. ..... 211/88.01
5,358,128 A * 10/1994 Belokin et al. ..... 211/75
5,486,044 A * 1/1996 Bennett ..... 312/321.5
5,531,336 A * 7/1996 Parham et al. ..... 211/183
5,586,665 A * 12/1996 Brousseau ..... 211/59.2
5,586,687 A * 12/1996 Spamer et al. ..... 221/298
5,669,527 A * 9/1997 Hardy ..... 221/191
5,695,074 A * 12/1997 Wiese ..... 211/59.2
5,706,958 A * 1/1998 Spamer ..... 211/59.2
5,706,978 A * 1/1998 Spamer et al. ..... 221/298
5,718,341 A * 2/1998 Robertson ..... 211/59.2
5,878,894 A * 3/1999 Robertson ..... 211/59.2
5,913,433 A 6/1999 Belokin et al.
D413,473 S * 9/1999 Belokin et al. ..... D6/574
D413,474 S * 9/1999 Belokin et al. ..... D6/574
6,059,125 A * 5/2000 Parham ..... 211/59.2
RE36,827 E * 8/2000 Belokin et al. ..... 211/75
6,360,901 B1 * 3/2002 Parham ..... 211/59.2
6,571,967 B1 * 6/2003 Belokin et al. ..... 211/71.01
6,588,606 B1 * 7/2003 Miller et al. ..... 211/88.01
6,718,667 B1 * 4/2004 Applebee ..... 40/597
2003/0080078 A1 * 5/2003 Belokin et al. ..... 211/88.01
2003/0222037 A1 * 12/2003 Belokin et al. ..... 211/75

* cited by examiner

*Primary Examiner*—Richard E. Chilcot, Jr.
*Assistant Examiner*—Lindsay M. Maguire
(74) *Attorney, Agent, or Firm*—John L. James

(57) ABSTRACT

A shelf device for an inside surface of a cooler door has a bottle neck-hanging device and a display panel. The bottle neck-hanging device has a sidewall with at least two slotted openings therein. The display panel is adjacent the sidewall and has slotted openings therein aligned with the openings of the sidewall. At least two suction cups attach the sidewall and display panel to the cooler door. Each of the suction cups has a protrusion extending through one of the openings in the display panel and a corresponding opening in the sidewall.

5 Claims, 4 Drawing Sheets

NECK-HANGING COOLER DOOR SHELF DEVICE

CROSS REFERENCE TO RELATED APPLICATIONS

This application is related to commonly assigned co-pending applications Ser. Nos. 10/929,975 filed Aug. 20, 2004 entitled "Cooler Door Shelf Device With Removable Product Panel"; Ser. No. 10/944,246, filed Sep. 16, 2004 entitled "Cooler Door Shelf Device With Stick-On Display Panels"; and Ser. No. 10/944,295, filed Sep. 16, 2004 entitled "Cooler Door Shelf Device With Raised Panels" and to co-filed application Ser. No. 10/947,472, entitled "Vented Cooler Door Shelf Device".

TECHNICAL FIELD OF THE INVENTION

This invention relates generally to a cooler, and, more particularly, to a door shelf device for a transparent cooler door.

BACKGROUND OF THE INVENTION

Upright coolers in supermarkets and convenience stores typically have transparent glass doors so that the products inside are visible. The inside of the cooler door can be used for shelving as is done in household refrigerators. Such shelving fits against the door so that the product containers are visible, however the product containers and labels do not always face forward for easy identification of the product. Some shelves have a small area for affixing product identification, but such small areas lack the impact needed, especially for impulse purchases. Accordingly, it will be appreciated that it would be highly desirable to have a door shelf device with a large area for product labeling and identification. Shelf devices typically lie horizontally which does not create visual appeal and does nothing to prevent containers from being disheveled. It is desirable to have a door shelf device that creates visual appeal and keeps containers orderly arranged.

SUMMARY OF THE INVENTION

The present invention is directed to overcoming one or more of the problems set forth above. Briefly summarized, according to one aspect of the present invention, a shelf device for a cooler door comprises a bottle neck-hanging device having a sidewall, a display panel, and means for attaching the sidewall and display panel to the cooler door. Affixing the bottle neck-hanging device to the cooler door places beverage bottles at the front of the cooler for easy access and greater visibility, and, also uses space at the front of the cooler that may otherwise remain unused. The display panel can be attached to the interior or exterior of the cooler door. Also, the display panel may be a two-piece panel with one piece on the interior and one piece on the exterior.

According to another aspect of the present invention, a shelf device for an inside surface of a cooler door comprises a bottle neck-hanging device having a sidewall with at least two openings therein; and a display panel adjacent the sidewall having openings therein aligned with the openings of the sidewall. At least two suction cups are provided for attaching the sidewall and display panel to the cooler door. Each of the suction cups has a protrusion extending through one of the openings in the display panel and a corresponding opening in the sidewall. The openings are slotted openings each having a lower portion larger than an upper portion thereof. The display panel has a lower portion configured as a downward pointing arrowhead and an upper portion configured to mimic a product brand. In use, the arrowhead points to product in the bottle neck-hanging device identified by the mimicked product brand on the upper portion of the display panel.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
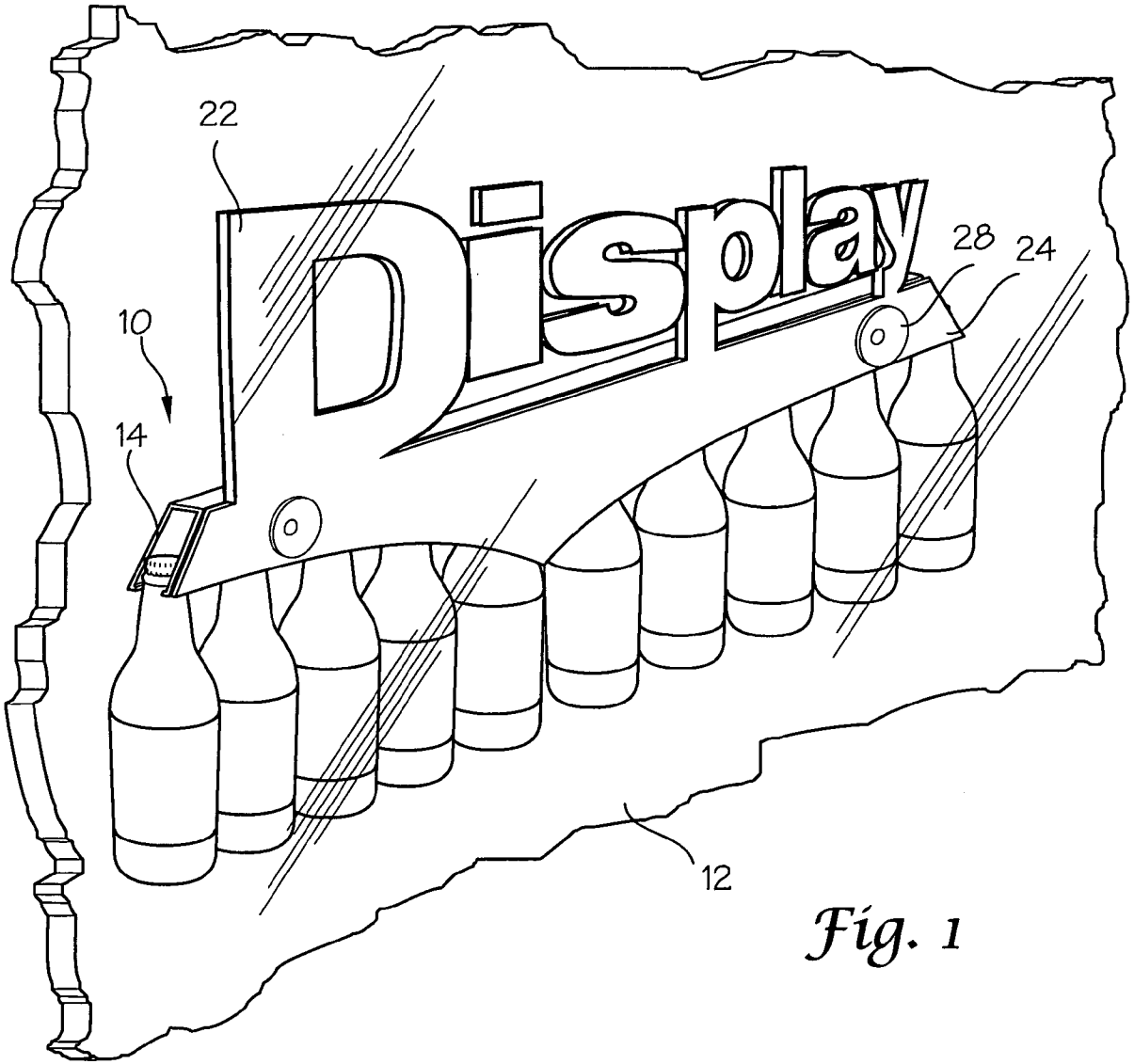
FIG. 1 is a front perspective view of a preferred embodiment of a bottle neck-hanging shelf device for a cooler door according to the present invention.
Figure 2:
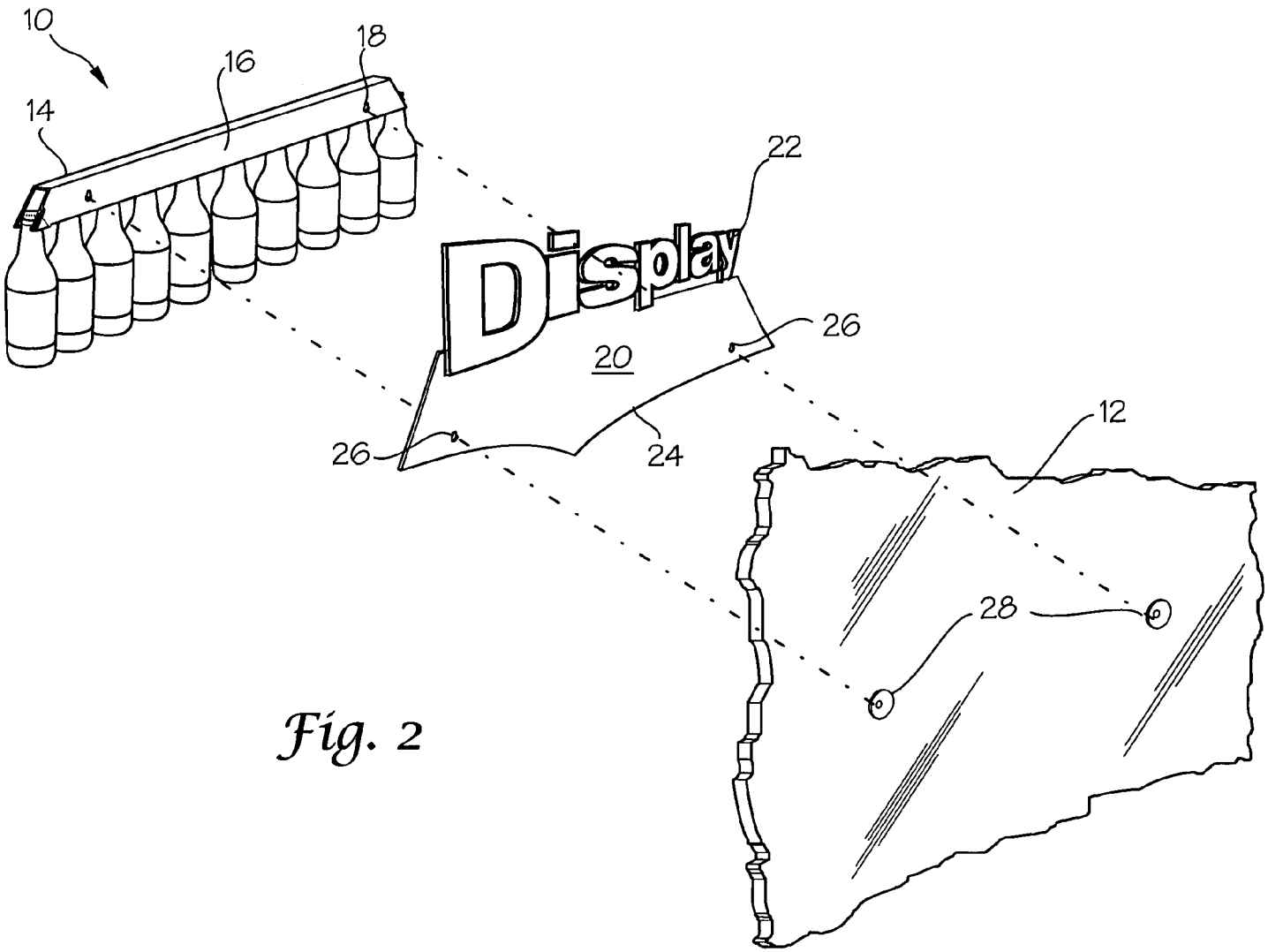
FIG. 2 is an exploded view of the device of FIG. 1 showing slotted openings for attaching to the cooler door.

Referring to FIGS. 1–2, a bottle neck-hanging track device 14 is mounted to a cooler door 12. Bottle neck-hanging devices are well known and described in U.S. Pat. Nos. 6,360,901 and 6,059,125, for example, the disclosures of which are incorporated herein by reference. Briefly, a bottle neck-hanging track device has parallel rails with flanges that hold a bottle by the neck as the bottle slides along the rails by gravity or with spring assist. Gravity feed requires the front end be at a lower elevation than the rear end so that the bottles feed forward. A dispensing mechanism inside the rails stops forward motion of a bottle along the rails and dispenses one bottle at a time when desired by a consumer.

FIGS. 1–2 illustrate a shelf device 10 for a cooler door 12 which includes a bottle neck-hanging device 14 having opposed sidewalls with one sidewall 16 adjacent cooler door 12. Sidewall 16 has at least two slotted openings 18 each of which has a lower portion that is larger than an upper portion. Bottle neck-hanging device 14 is preferably constructed of plastic with the dispensing mechanism constructed of metal.

A display panel 20 has upper and lower portions 22, 24 and at least two openings 26, preferably slotted and aligned with openings 18 of the sidewall. Lower portion 24 is preferably configured as an arrowhead pointing downward toward the bottles in the bottle neck-hanging device 14. Upper portion 22 is preferably configured as a product brand name, trademark or logo. For purpose of illustration, the upper portion 22 is configured as "DISPLAY".

Display panel 20 may be adhered to sidewall 16 and the unit so formed attached to the inside surface of cooler door 12. Alternatively, display panel 20 may be adhered to the inside surface of cooler door 12 and sidewall 16 then attached using studs or suction cups 28 that fit through the aligned openings 18, 26. Most preferably, display panel is not adhered to any surface but is held in position between door 12 and sidewall 16 when the protrusions extend through the aligned openings. By not adhering display 20 to any surface, it can be changed when the product is changed. By this construction, the suction cups 28 and slotted openings 18, 26 form a means for attaching sidewall 16 and display panel 20 to cooler door 12.

Figure 3:
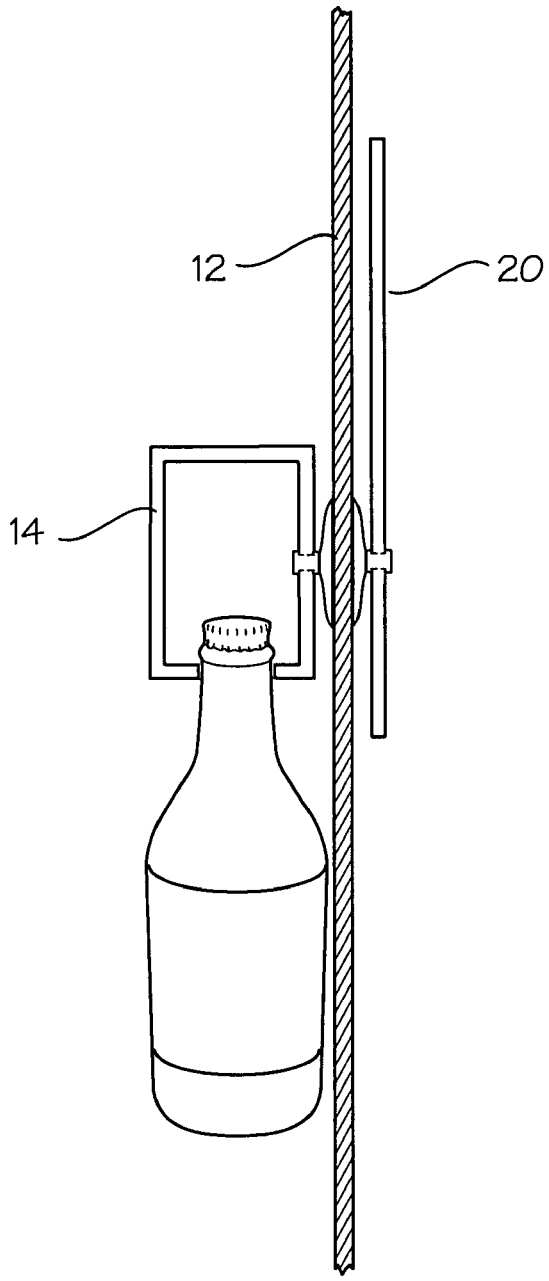
FIG. 3 is a diagrammatic top view of another embodiment of the device with track on rear of door and panel on front.

Referring to FIG. 3, display panel 20 is attached to an exterior surface of cooler door 12 while bottle neck-hanging device 14 is attached to an interior surface of door 12. By adhering display panel 20 to an exterior surface, it can be changed without the necessity of removing device 14.

Figure 4:
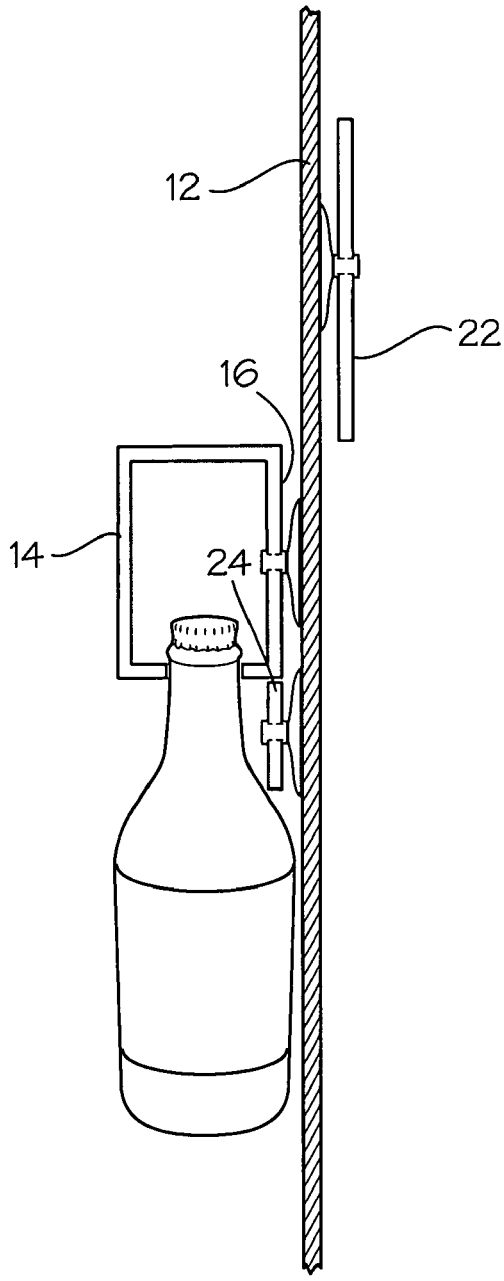
FIG. 4 is a diagrammatic side view of another embodiment of the device with track and lower panel portion on rear of door and upper panel portion on front.

Referring to FIG. 4, display panel 20 is a two-piece panel with an upper portion 22 and a lower portion 24. Upper portion 22 is attached to an exterior surface of cooler door 12 and lower portion 24 is attached to an interior surface of cooler door 12. By adhering upper portion 22 to an exterior surface, it can be changed without the necessity of removing device 14. Lower portion 24 may be attached to an interior surface of cooler door 12. Adhering lower portion 24 to an interior surface allows the arrowhead to remain in place while changing the upper portion configured to mimic a product brand.

Figure 5:
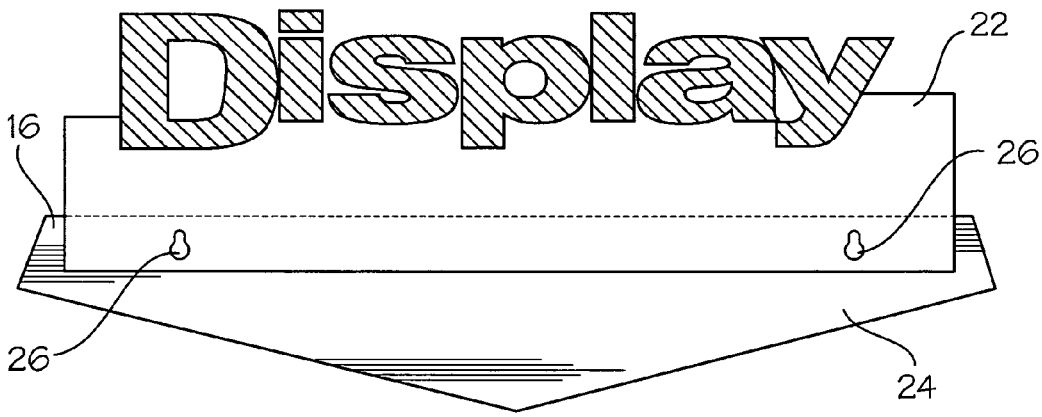
FIG. 5 is a diagrammatic front view of another embodiment of the device with track and lower panel integrally formed.

Referring to FIG. 5, the display panel is a two-piece panel with an upper portion 22 and a lower portion 24. Upper portion 22 has slotted openings 26. Lower portion 24 is integrally formed with sidewall 16. Sidewall 16 has slotted openings aligned with the openings in upper portion 22. By integrally forming sidewall 16 and lower portion 24, product identification can be readily changed.

It can now be appreciated that a door shelf device has a relatively large area for product labeling and identification. The shelf device is slanted allowing for more product to be displayed and creating visual appeal. The bottle neck-hanging device prevents bottles from being disheveled. The display panel identifies the product.

While the invention has been described with particular reference to the preferred embodiments, it will be understood by those skilled in the art that various changes may be made and equivalents may be substituted for elements of the preferred embodiments without departing from invention. For example, the display panel may be formed of rigid plastic or may be flexible like a decal.

As is evident from the foregoing description, certain aspects of the invention are not limited to the particular details of the examples illustrated, and it is therefore contemplated that other modifications and applications will occur to those skilled in the art. For example, the display panel could be mounted on top of the bottle neck-hanging device and not actually attached to the cooler door at all. It is accordingly intended that the claims shall cover all such modifications and applications as do not depart from the true spirit and scope of the invention.

ELEMENTS LIST

10 shelf device
12 cooler door
14 bottle neck-hanging track device
16 sidewall of track device
18 slotted openings in sidewall
20 display panel for product identification
22 upper portion of display panel
24 lower portion of display panel
26 slotted openings in display panel
28 suction cups

The invention claimed is:

1. A shelf device for an inside surface of a cooler door, comprising:

a gravity feed bottle neck-hanging device having first and second opposed downwardly slanted sidewalls adapted to hold a row of bottles with each bottle of the row of bottles held by its neck as the bottle slides downward along said slanted sidewalls, said first sidewall having at least two openings therein;

a display panel adjacent said first sidewall having openings therein aligned with said openings of said first sidewall; and at least two suction cups for attaching said first sidewall and said display panel to said cooler door, each of said suction cups having a protrusion extending through one of said openings in said display panel and a corresponding opening in said first sidewall.

2. A shelf device, as set forth in claim 1, wherein said display panel is attached to said first sidewall.

3. A shelf device, as set forth in claim 1, wherein said display panel has a lower portion configured as a downward pointing arrowhead.

4. A shelf device, as set forth in claim 1, wherein said display panel has an upper portion configured to display a product brand.

5. A shelf device, as set forth in claim 1, wherein said sidewall has a lower portion configured as a downward pointing arrowhead.

* * * * *